US008544142B2

(12) United States Patent
Tso et al.

(10) Patent No.: US 8,544,142 B2
(45) Date of Patent: Oct. 1, 2013

(54) DUST CONTAINER AND DUST COLLECTOR USING THE SAME

(75) Inventors: Tse-Ying Tso, New Taipei (TW); You-Wei Teng, New Taipei (TW)

(73) Assignee: MSI Computer (Shenzhen) Co., Ltd., Shenzhen, Guangdong Province (CN)

( * ) Notice: Subject to any disclaimer, the term of this patent is extended or adjusted under 35 U.S.C. 154(b) by 393 days.

(21) Appl. No.: 13/091,733

(22) Filed: Apr. 21, 2011

(65) Prior Publication Data

US 2012/0180249 A1 Jul. 19, 2012

(30) Foreign Application Priority Data

Jan. 14, 2011 (TW) ..... 100200897 U

(51) Int. Cl.
*A47L 9/10* (2006.01)

(52) U.S. Cl.
USPC ..... 15/347; 15/319; 15/352; 55/357; 55/359; 55/428; 55/DIG. 3

(58) Field of Classification Search
USPC ..... 15/319, 347, 352; 55/356, 357, 55/359, 428, 429, DIG. 3
IPC ..... A47L 9/10
See application file for complete search history.

(56) References Cited

U.S. PATENT DOCUMENTS

| | | | | |
|---|---|---|---|---|
| 8,341,802 | B2 * | 1/2013 | Kim et al. | 15/319 |
| 2005/0015920 | A1 * | 1/2005 | Kim et al. | 15/352 |

FOREIGN PATENT DOCUMENTS

| | | | |
|---|---|---|---|
| CN | 1390105 | A | 1/2003 |
| CN | 101612022 | A | 12/2009 |
| TW | M294295 | U | 7/2006 |

* cited by examiner

*Primary Examiner* — David Redding
(74) *Attorney, Agent, or Firm* — Morris Manning & Martin LLP; Tim Tingkang Xia, Esq.

(57) ABSTRACT

The dust container is disposed in the dust collector, so as to receive dirt drawn by the dust collector. The dust container includes a fastening device. The dust container can be taken out from the dust collector by operating the fastening device in one operation, and then installed back into the dust collector after the dirt is cleared away, thereby completing actions of disassembling, assembling and clearing the dust container quickly and cleanly.

20 Claims, 10 Drawing Sheets

DUST CONTAINER AND DUST COLLECTOR USING THE SAME

CROSS-REFERENCE TO RELATED APPLICATIONS

This non-provisional application claims priority under 35 U.S.C. §119(a) on Patent Application No. 100200897 filed in Taiwan, R.O.C. on Jan. 14, 2011, the entire contents of which are hereby incorporated by reference.

BACKGROUND OF THE INVENTION

1. Field of Invention

The present invention relates to a container, and more particularly to a dust container for storing dirt by a mobile sweeping machine.

2. Related Art

In order to keep the cleanliness and hygiene of the indoor environment, people will regularly tidy and clean the house, and rags, mops, and dust collectors are usually the most common appliances used for cleaning dirt. Generally, the dust collector is the best tool for dealing with dirt. The cleaning principle of the dust collector is mainly to form a negative pressure inside the dust collector to generate an inward suction force by means of rotation of an suction fan, so as to draw dirt attached to the floor, carpet, walls, furniture or other surfaces that cannot be easily cleaned with a rag or broom, and collect the dirt into a dust container inside the dust collector.

Ordinary dust collectors need to be operated by users. With the evolution of science and technology, a sweeping robot with automatic dust collecting functions has emerged at present. The sweeping robot can automatically advance on the ground to take away dirt on the ground, so as to complete the cleaning task without requiring any labor force.

After the sweeping robot automatically collects dust for a period of time, the dust container will contain a lot of dirt, and the user must take the dust container out from the sweeping robot, so as to remove the dirt inside the dust container. For example, the conventional sweeping robot is designed with a fastening structure to fix the dust container; in order to take the dust container out from the sweeping robot, it is necessary to release the fastening structure on the sweeping robot first. If the sweeping robot is further designed with an outer cover, the action of taking out the dust container becomes more complicated. After the dust container is taken out, the dirt cannot be cleared away unless the cover of the dust container is opened. For such a complicated and inconvenient action, when clearing the dust container, the user may easily contact the dirt or even make the dirt in the dust container fall all over the ground when disassembling and fetching the dust container due to the complicated or inconvenient disassembling and assembling actions.

SUMMARY OF THE INVENTION

In view of the above problems, the present invention is a dust container and a dust collector using the same, so as to solve the problem in the prior art that the user cannot disassemble, assemble and clear the dust container quickly and cleanly.

The dust container according to the present invention is detachably disposed in a dust collector. The dust collector comprises a pair of buckle slots, and the dust container comprises a receiving body and a first fastening device. The receiving body comprises a lid and a case. The first fastening device is disposed in the lid, and comprises a pair of movable first operating members and a first elastic member between the first operating members, and the first operating members each comprise a first fastening member. The first operating members have a fixing position normally butted by the first elastic member and a releasing position for relatively compressing the first elastic member; at the releasing position, the first fastening members retract into the lid, and at the fixing position, the first fastening members protrude out of the lid; and when the receiving body is assembled to the dust collector, the first fastening members extend into the buckle slots.

The dust collector according to the present invention comprises a body and a dust container. The body comprises a take-out opening and a pair of buckle slots, and the take-out opening comprises a receiving space. In addition, the dust container is detachably disposed in the receiving space, and the dust container comprises a receiving body and a first fastening device. The receiving body comprises a lid and a case. The first fastening device is disposed in the lid, and comprises a pair of movable first operating members and a first elastic member between the first operating members, and the first operating members each comprise a first fastening member. The first operating members have a fixing position normally butted by the first elastic member and a releasing position for relatively compressing the first elastic member; at the releasing position, the first fastening members retract into the lid, and at the fixing position, the first fastening members protrude out of the lid; and when the receiving body is assembled to the dust collector, the first fastening members extend into the buckle slots.

The effect of the dust container and the dust collector using the same according to the present invention lies in that, the removing and fetching actions are integrated by means of the first fastening device disposed on the dust container, so that the user can easily take out the dust container, without contacting dirt due to complicated disassembling or fetching actions, and thus can complete the action of clearing the dust container quickly.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
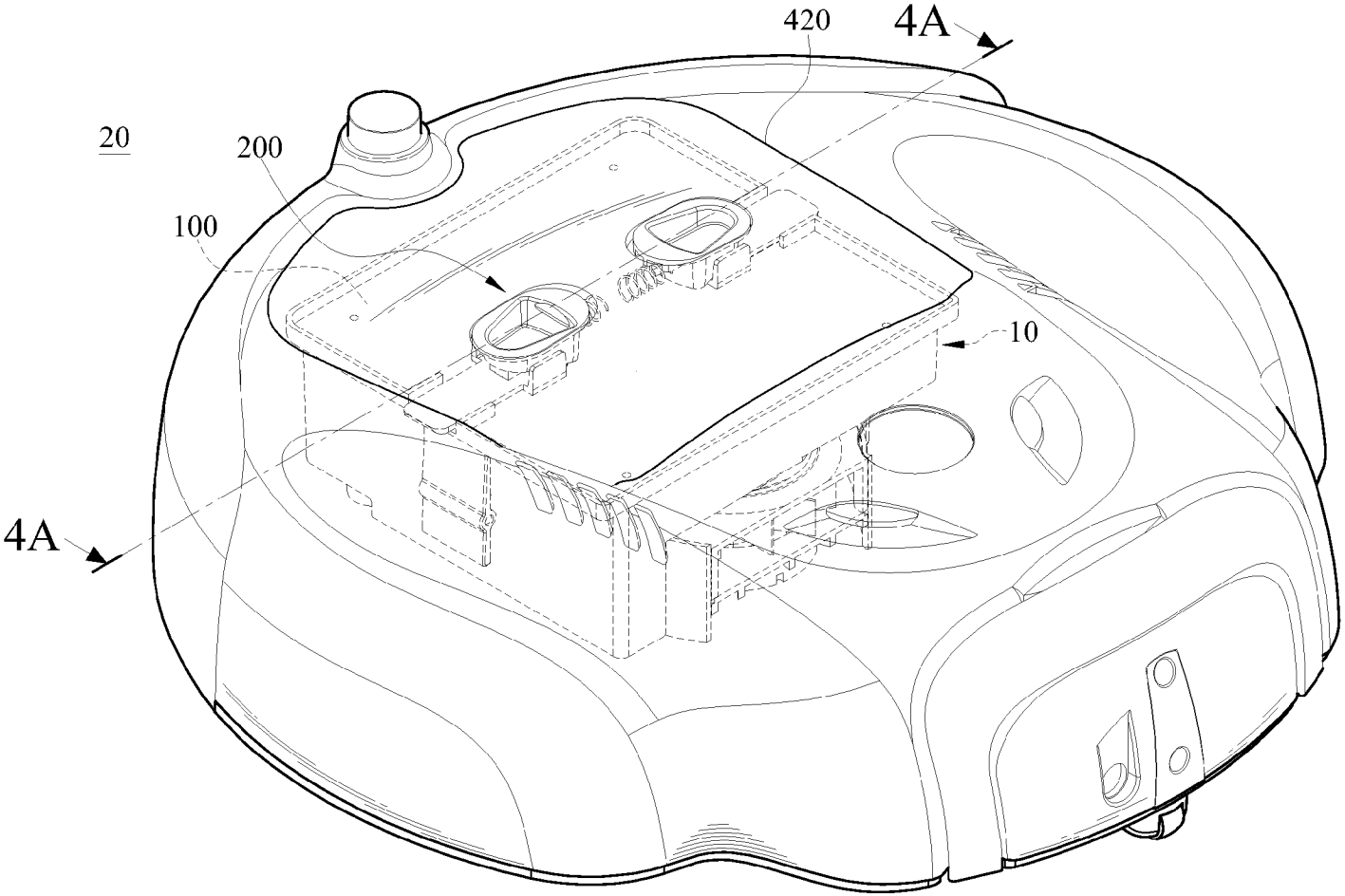
FIG. 1 is a schematic three-dimensional view of a dust container being disposed in a dust collector according to an embodiment of the present invention.
Figure 2:
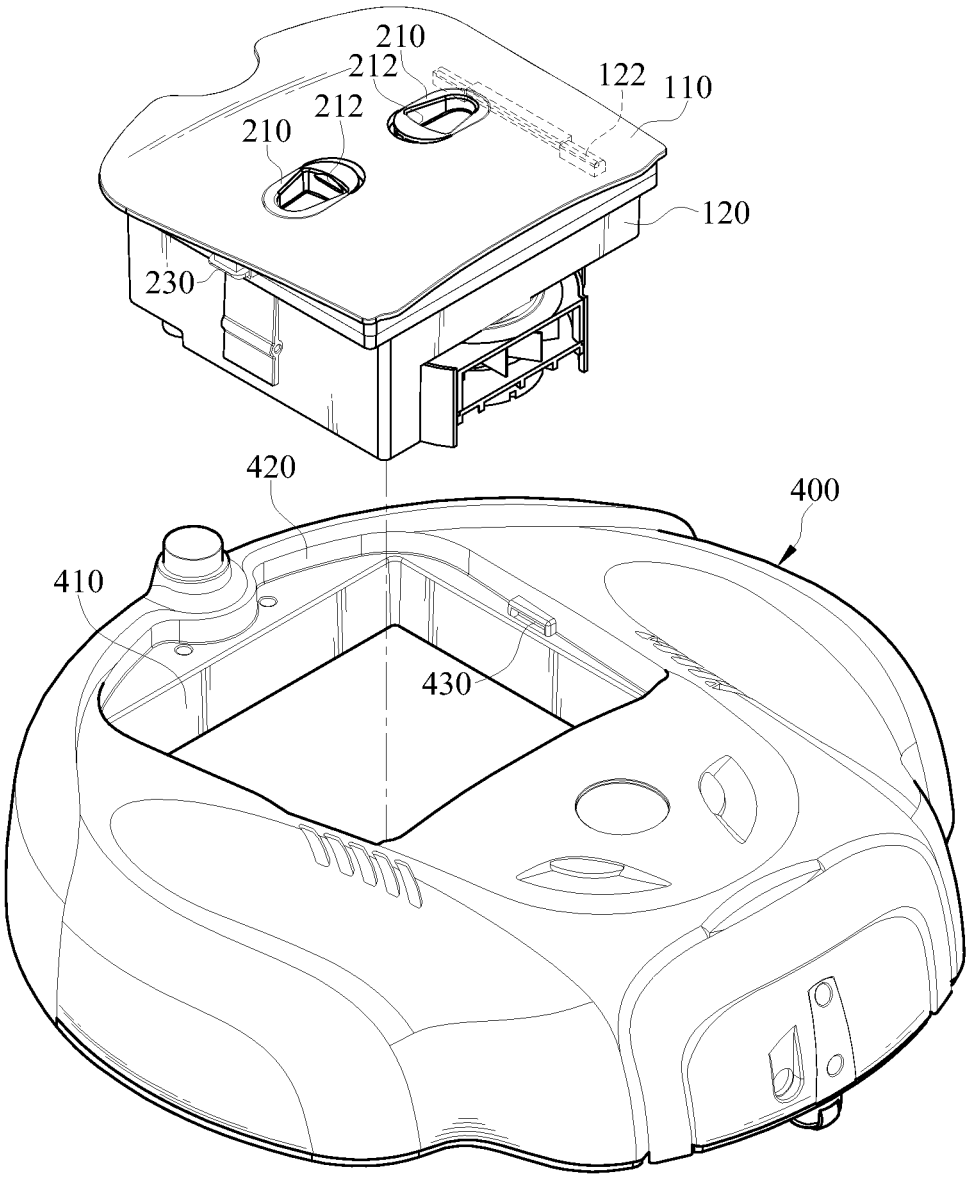
FIG. 2 is a schematic three-dimensional view of a dust container being detached from a dust collector according to an embodiment of the present invention.

Referring to FIG. 1 and FIG. 2, According to the dust container 10 and the dust collector 20 using the same in the present invention, the dust collector 20 comprises, but is not limited to, a sweeping robot, a household vacuum cleaner or an industrial vacuum cleaner. However, in specific embodiments of the present invention below, the sweeping robot is taken as an example for illustrating the present invention. The dust collector 20 comprises a body 400, the body 400 is disposed with a chamber 410 capable of receiving the dust container 10, the chamber 410 comprises an opening 420, and a pair of buckle slots 430 is disposed at corresponding positions at two sides of the chamber 410. The dust container 10 may be installed in the chamber 410 of the dust collector 20 or be taken out from the chamber 410.

Figure 3A:
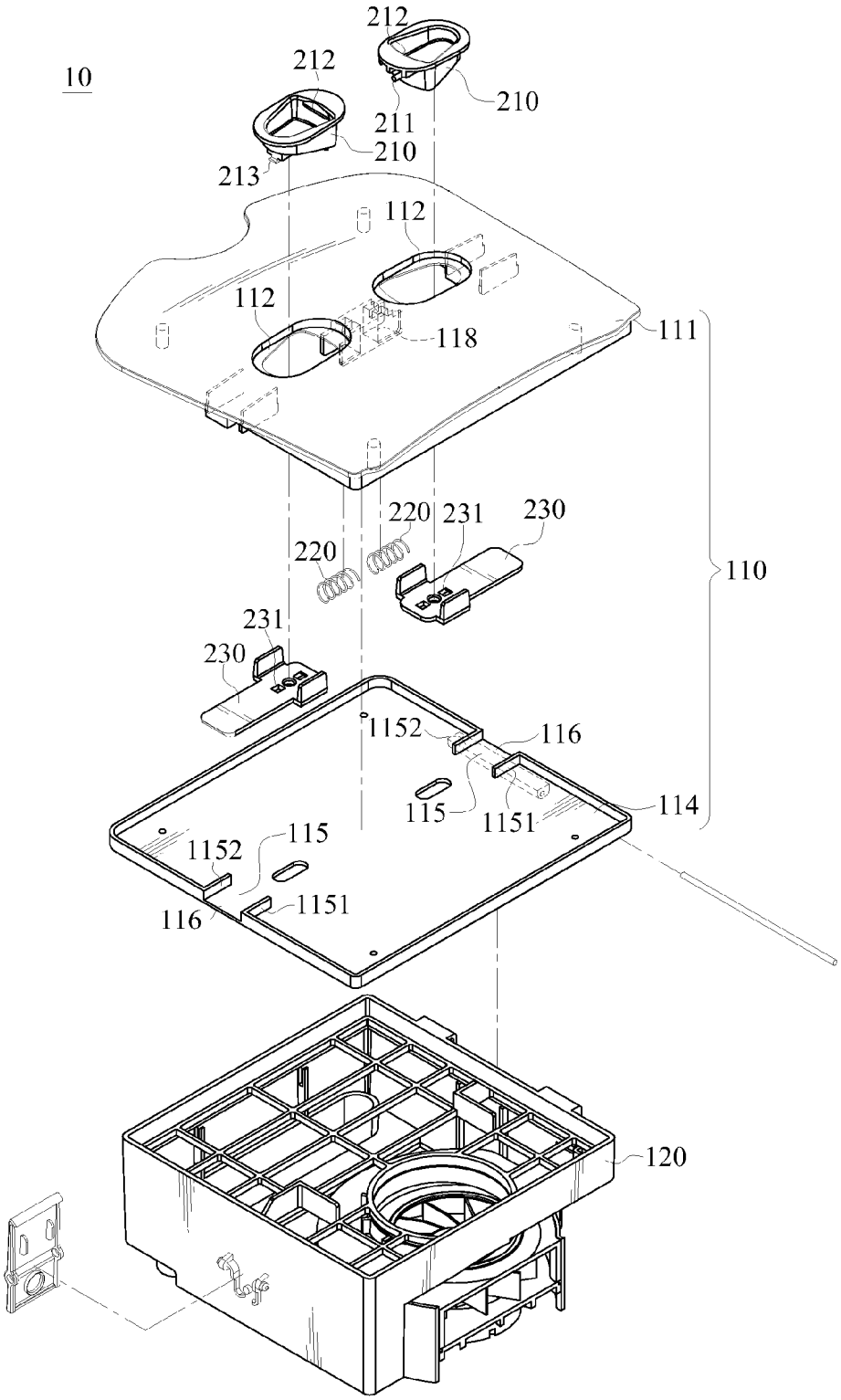
FIG. 3A is a schematic exploded view according to an embodiment of the present invention.
Figure 3B:
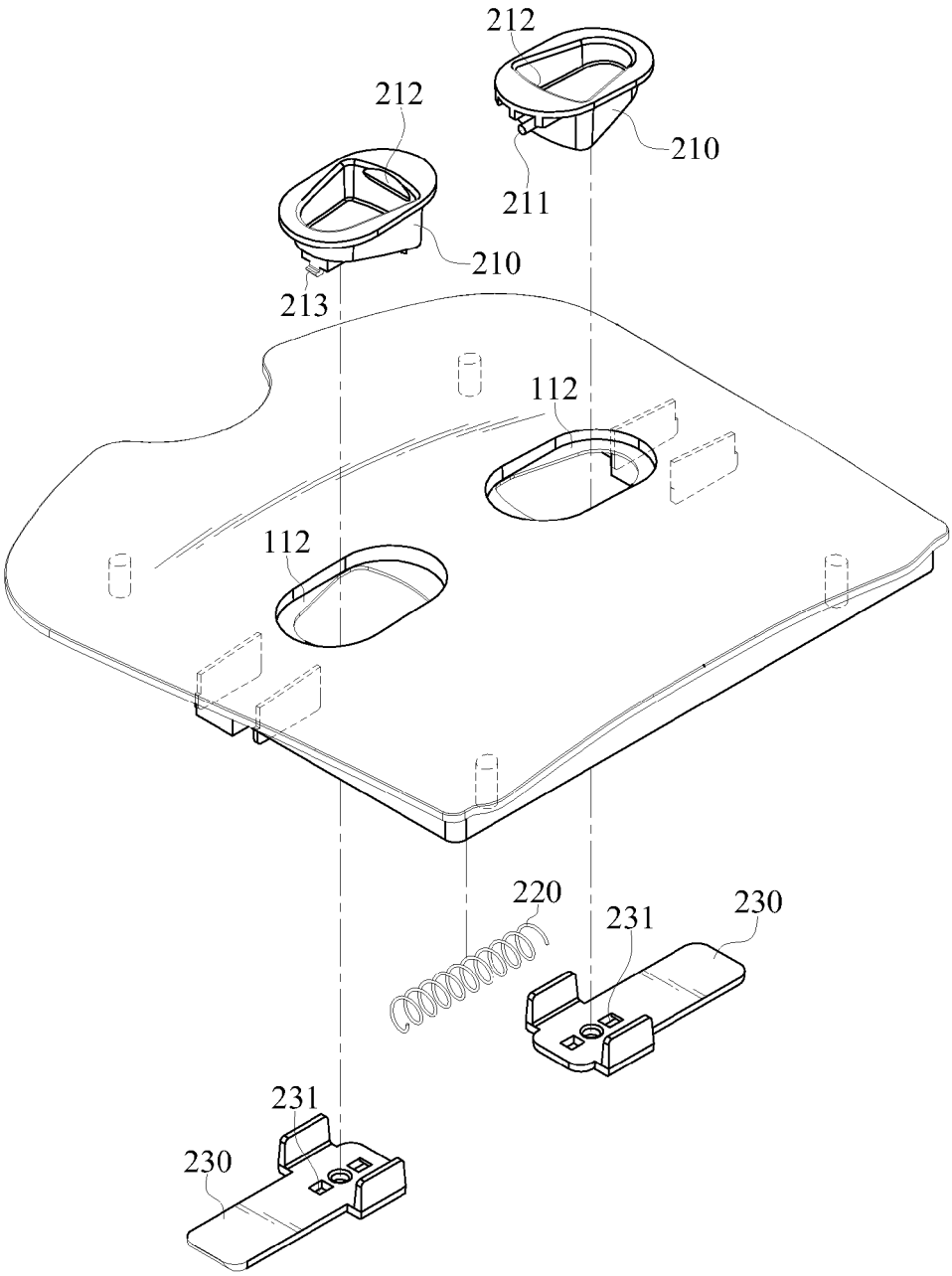
FIG. 3B is a schematic exploded view of a first lid according to another embodiment of the present invention.

Referring to FIG. 3A and FIG. 3B, FIG. 3A is a schematic exploded view according to an embodiment of the present invention, and FIG. 3B is a schematic exploded view of a first lid according to another embodiment of the present invention. The dust container 10 according to the present invention comprises a receiving body 100 and a first fastening device 200.

The receiving body 100 comprises a case 120 and a lid 110 pivoted to one side of the case 120, and the lid 110 is capable of closing the case 120 or being rotated away from the case 120. The lid 110 is formed by an upper lid 111 and a lower lid 114, and a receiving space is formed between the upper lid 111 and the lower lid 114. The upper lid 111 comprises a pair of guide slots 112, and the guide slots 112 have an approximately U-shaped section. The pair of guide slots 112 are located on the same straight line. In addition, an inner side surface of the upper lid 111 is disposed with a butting portion 118 between the pair of guide slots 112.

Two protruding ribs 1151 and 1152 spaced by a distance are disposed on the lower lid 114 corresponding to the pair of guide slots 112, the two protruding ribs 1151 and 1152 form a first sliding chute 115, and the first sliding chute 115 forms a moving path. Two first sliding chute openings 116 are disposed on two sides of the lower lid 114 corresponding to the first sliding chute 115.

The first fastening device 200 comprises a pair of first operating members 210, a pair of first elastic members 220 and a pair of first fastening members 230. The first operating members 210 are substantially L-shaped, slideably disposed in the first guide slots 112 correspondingly, and located in the first sliding chute 115. A finger lock portion 212 for being held with a finger is disposed at a top edge of the first operating member 210. A buckling portion 213 is disposed on one side of the bottom of the first operating member 210, and a pressing portion 211 is disposed on the other side.

The first fastening member 230 is stripe-shaped, a connecting portion 231 is disposed at the first fastening member 230, and the first fastening member 230 is combined with the buckling portion 213 through the connecting portion 231.

The first elastic member 220 is compression-deformable, and may be, but is not limited to, a compression spring in this embodiment. Two ends of the first elastic member 220 press against the butting portion 118 and the pressing portion 211 respectively, so as to provide an elastic force for pressing and restoration of the first operating members 210. Referring to another embodiment of the present invention shown in FIG. 3B, the number of the first elastic members 220 may be one, and the upper lid 11 may not be disposed with the butting portion 118. The two ends of the first elastic member 220 directly press against the pressing portions 211 of the two first operating members 210 respectively and are located between the two first operating members 210.

The first operating members 210 have a fixing position normally butted by the first elastic member 220 and a releasing position for relatively compressing the first elastic member 220. At the fixing position, the first fastening members 230 protrude out of the lid 110 through the first sliding chute openings 116. At the releasing position, the first fastening members 230 retract into the lid 110 through the first sliding chute openings 116.

Figure 4A:
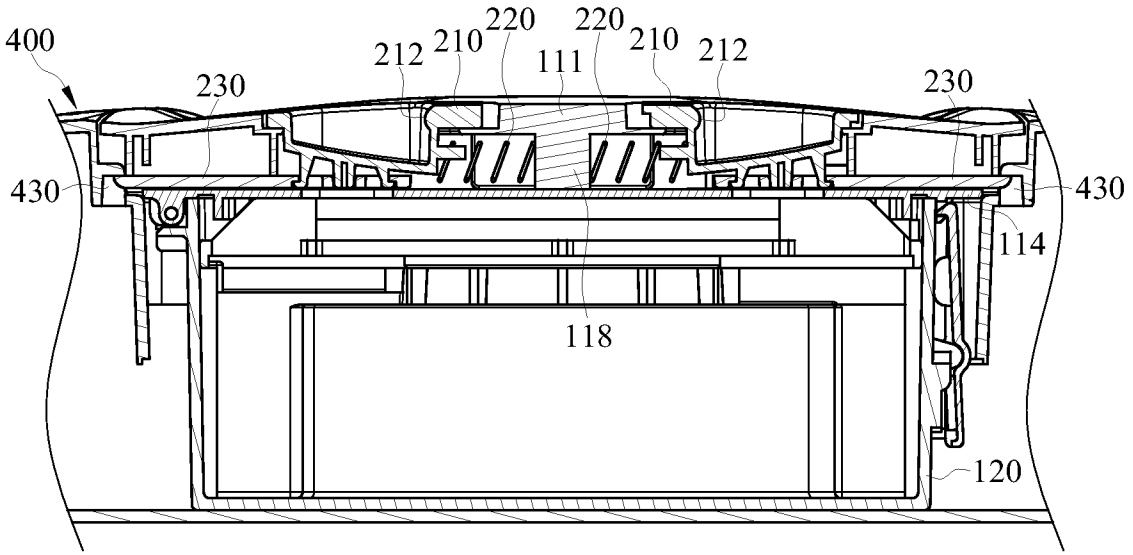
FIG. 4A is a schematic cross-sectional view of a receiving body being fastened to a dust collector according to an embodiment of the present invention.
Figure 4B:
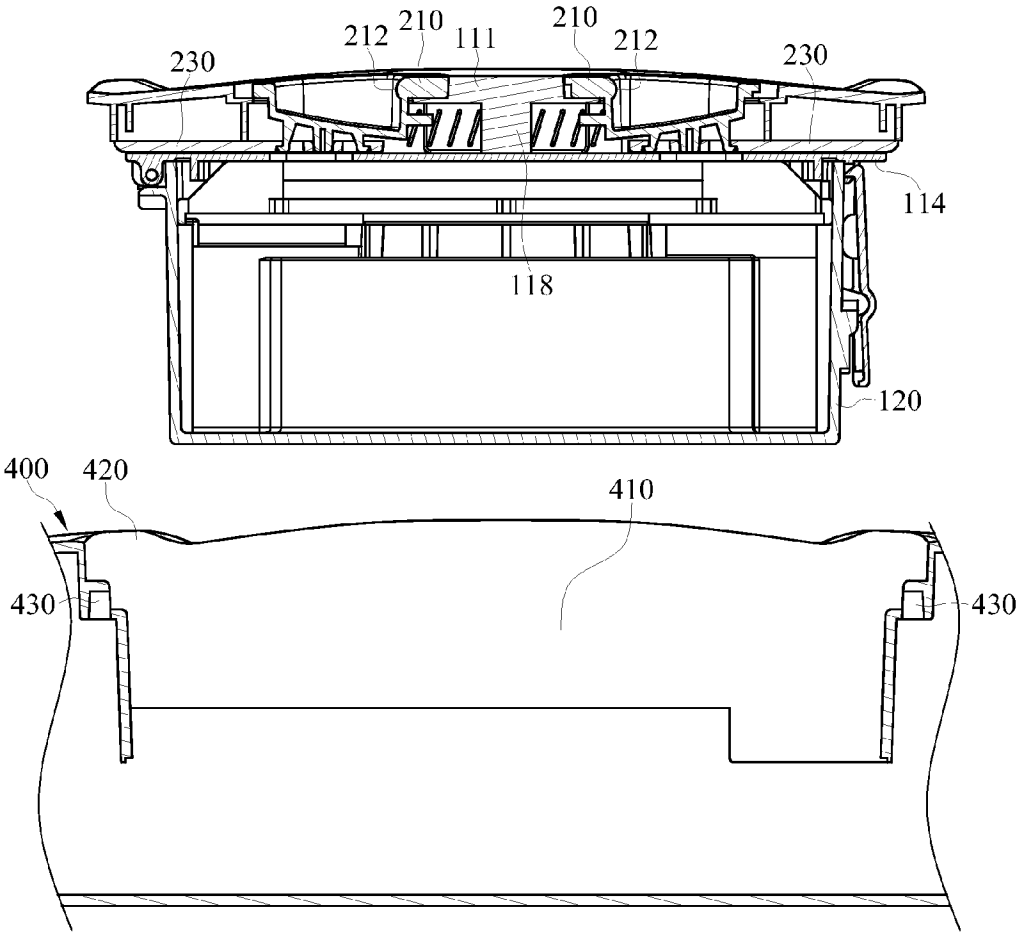
FIG. 4B is a schematic cross-sectional view of the receiving body being taken out from the dust collector in FIG. 4A.

FIG. 4A and FIG. 4B illustrate how the receiving body 100 is taken out from the dust collector 20. First, the case that the dust container 10 has been disposed in the chamber 410 of the dust collector 20 is taken as an example. In such a state, the two first operating members 210 are located at the fixing position. Thus, the first fastening members 230 extend into the corresponding buckle slots 430, so that the dust container 10 is fixed in the chamber 410 and cannot be detached. For example, when the dust container 10 has collected a certain amount of dirt, the user can take the dust container 10 out. When intending to take the dust container 10 out, the user uses the thumb and middle finger of one hand to respectively clip the finger lock portions 212 on the two first operating members 210, applies a force to move the first operating members 210 relatively inwards to the releasing position, and drives the first fastening members 230 to exit the buckle slots 430 and retract into the lid 110. At this time, the dust container 10 is not restricted, the thumb and middle finger of the user still clip the finger lock portions 212, and the user can take the dust container 10 out from the dust collector 20 by raising the arm. In this way, the actions of releasing and taking out the dust container 10 can be completed in one operation, and the lid 110 can be lifted to remove the dirt subsequently.

Figure 5:
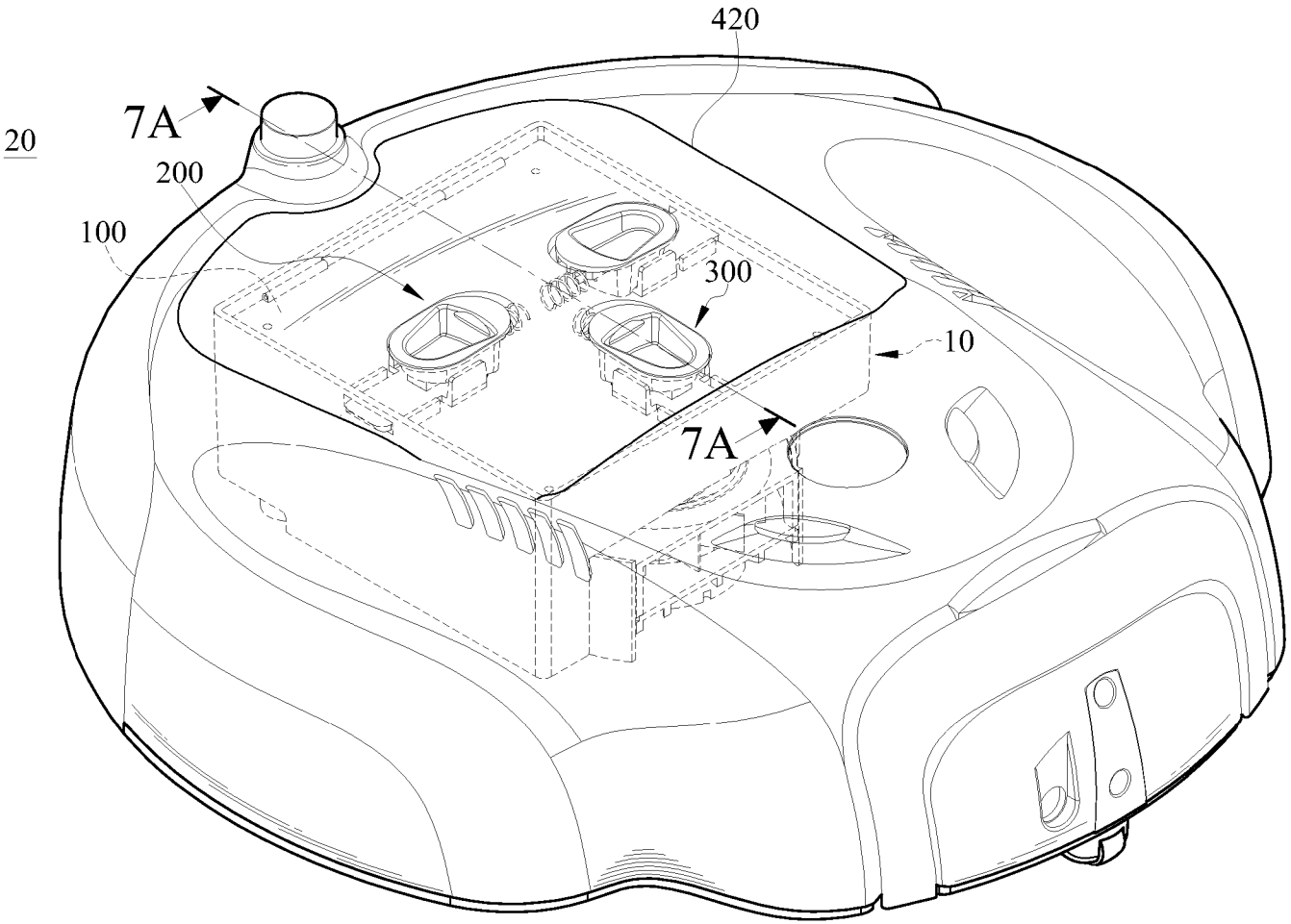
FIG. 5 is a schematic three-dimensional view according to yet another embodiment of the present invention.
Figure 6:
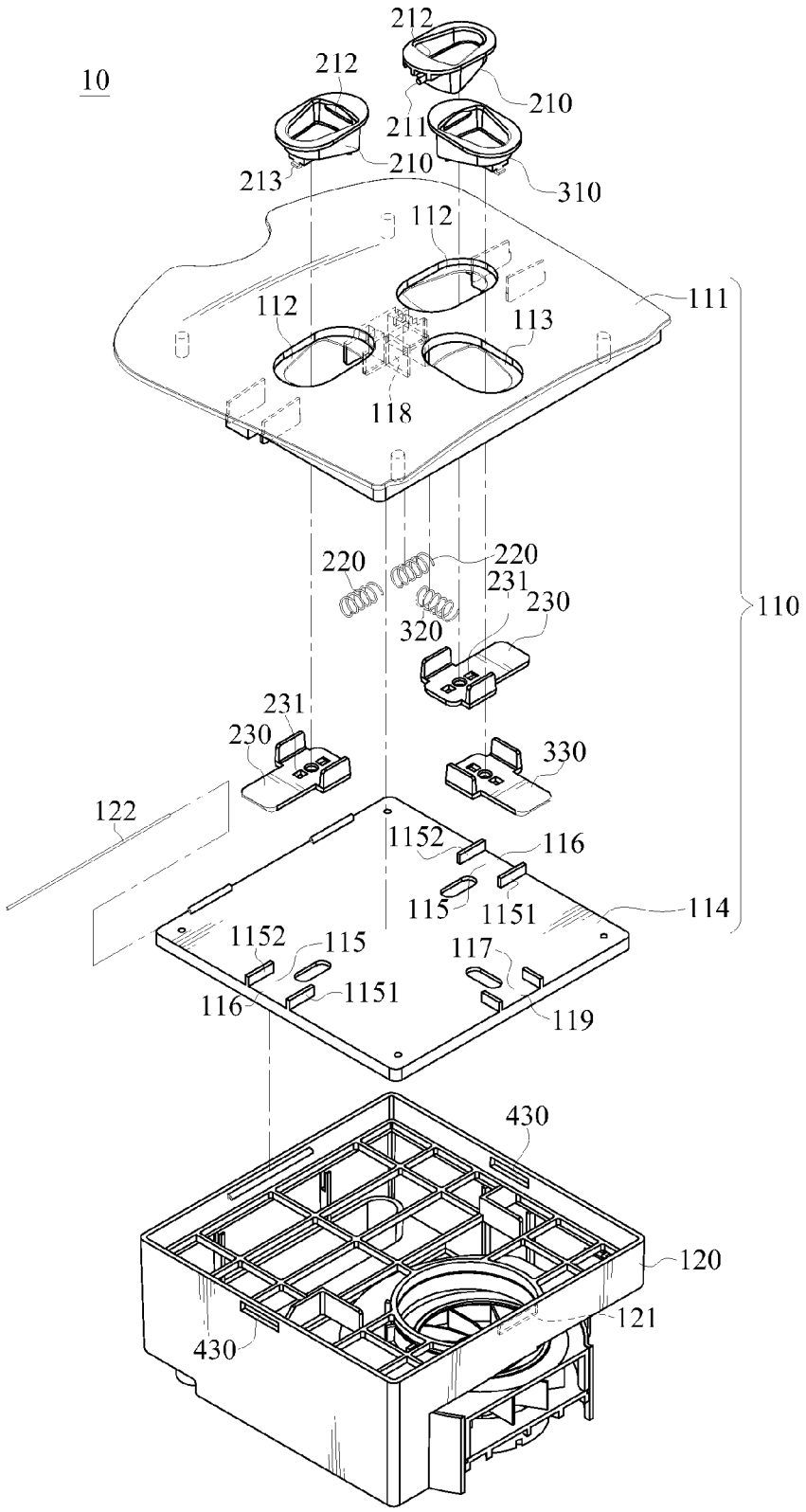
FIG. 6 is a schematic exploded view of FIG. 5.

FIG. 5 and FIG. 6 illustrate yet another embodiment according to the present invention. In the previous embodiment, the user can complete the releasing and taking-out actions in one operation, and hooks (not shown) may be additionally disposed for closing and opening the case 120 and the lid 110. In the second embodiment, in order to enable the user to take out the dust container 10 and open the lid 110 in one operation, a second fastening device 300 is further disposed on the dust container 10.

The second fastening device 300 is substantially the same as the first fastening device 200, and the operating direction of the second fastening device 300 is perpendicular to that of the first fastening device 200, so that the operating actions will not interference with each other.

The lid 110 is pivoted to the case 120 by means of a pivot member 122, a notch 121 is disposed on the other side of the case 120 opposite to the pivoting position, the upper lid 111 needs to be disposed with a second guide slot 113, and the lower lid 114 needs to be disposed with a second sliding chute 117 and a second sliding chute opening 119 corresponding to the second sliding chute 117. The second fastening device 300 comprises a second operating member 310, a second elastic member 320 and a second fastening member 330. The second operating member 310 is slideably disposed in the second guide slot 113, and other detailed structures of the second operating member 310 are substantially the same as those of the first operating members 210.

Figure 7A:
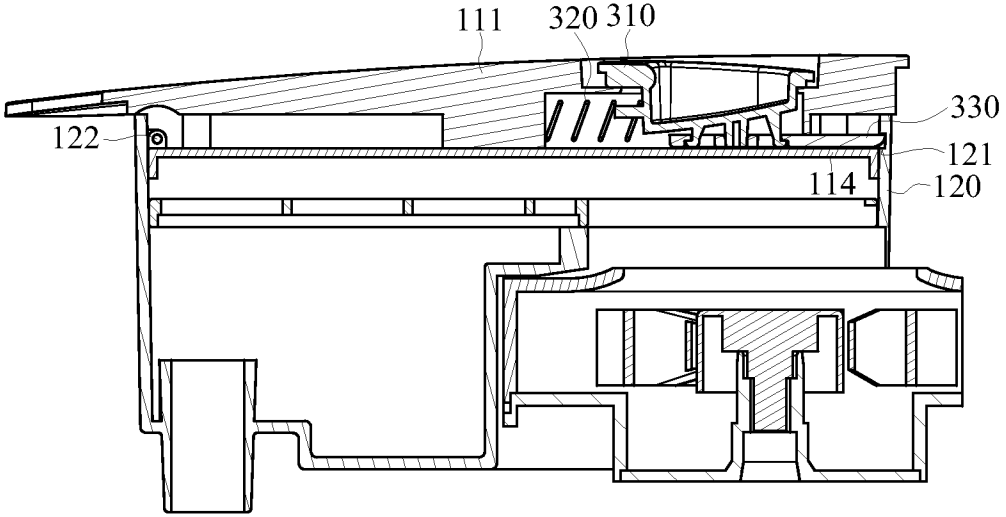
FIG. 7A is a schematic cross-sectional view of a receiving body before being opened according to yet another embodiment of the present invention.
Figure 7B:
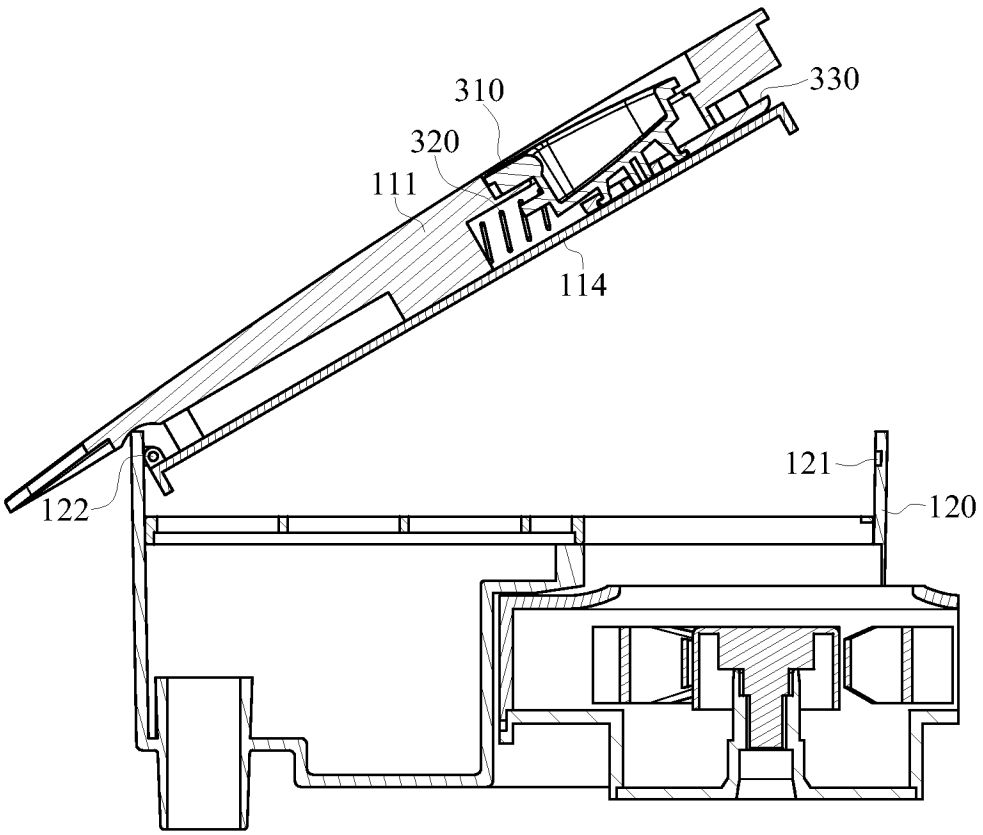
FIG. 7B is a schematic cross-sectional view of the receiving body in FIG. 7A after being opened.

Referring to FIG. 7A and FIG. 7B, after completing the releasing and taking-out actions as shown in FIG. 4A and FIG. 4B, the thumb and middle finger of the user can still clip the finger lock portions 212 of the two first operating members 210, and the other hand of the user can grip an appropriate position of the case 120. In such a state, the second fastening member 330 extends into the corresponding notch 121 through the second sliding chute opening 119, so that the lid 110 closes the case 120 and cannot be detached. Next, the user needs to use the forefinger to move the second operating member 310 to compress the second elastic member 320, so that the second fastening member 330 retracts into the lid 110 and departs from the notch 121. At this time, the lid 110 can be opened even if the thumb, middle finger and forefinger do not leave the first operating members 210 and the second operating member 310, so as to remove the dirt inside the case 120.

The effect of the dust container and the dust collector using the same according to the present invention lies in that, the gripping portion and the structure for releasing the buckle device are integrated by means of the first fastening device, and the first fastening device is disposed on a surface of the receiving body, and is exposed outside of an opening of the dust collector, so that the user can directly operate the first fastening device to detach the dust container from the dust collector through the opening when intending to clear away the dirt inside the dust container. Therefore, the action of releasing the buckle device can be omitted. When the dust collector comprises an outer cover, the action of lifting the outer cover is also omitted. Thus, the actions of gripping the dust container and releasing the buckle device are completed in one operation.

In addition, the second fastening device and the first fastening device are further integrated, so that the user can operate the first fastening device and the second fastening device at the same time, thereby integrating the actions of taking out the dust container and lifting the dust container. In this way, it is convenient for the user to take the dust container out from the dust collector by operating the fastening devices, and to install the dust container back into the dust collector after clearing away the dirt, thereby completing actions of disassembling, assembling and clearing the dust container quickly and cleanly.

What is claimed is:

1. A dust container, detachably disposed in a dust collector comprising a pair of buckle slots, the dust container comprising:

a receiving body, comprising a lid and a case; and a first fastening device, disposed in the lid, the first fastening device comprising a pair of movable first operating members and a first elastic member between the first operating members, the pair of first operating members each comprising a first fastening member;

wherein the pair of first operating members have a fixing position normally butted by the first elastic member and a releasing position for relatively compressing the first elastic member; at the releasing position, the pair of first fastening members retract into the lid, and at the fixing position, the pair of first fastening members protrude out of the lid; and when the receiving body is assembled to the dust collector, the pair of first fastening members extend into the pair of buckle slots.

2. The dust container according to claim 1, wherein the first fastening device further comprises two first elastic members, the lid further comprises a butting portion, and the first elastic members are disposed between the butting portion and the pair of first operating members respectively.

3. The dust container according to claim 1, wherein the lid is pivoted to the case.

4. The dust container according to claim 1, wherein the lid comprises a pair of first sliding chutes, and the pair of first fastening members are movably disposed at the pair of first sliding chutes.

5. The dust container according to claim 1, wherein the lid comprises a pair of first sliding chute openings corresponding to the pair of first fastening members, and the pair of first fastening members extend out of the lid through the pair of first sliding chute openings.

6. The dust container according to claim 1, wherein the pair of first operating members further comprise a finger lock portion respectively.

7. The dust container according to claim 3, wherein the lid and the case are disposed with a second fastening device correspondingly.

8. The dust container according to claim 7, wherein the second fastening device comprises a movable second operating member and a second elastic member, the second operating member further comprises a second fastening member, and a notch corresponding to the second fastening member is disposed in the case.

9. The dust container according to claim 8, wherein the lid comprises a second sliding chute, and the second fastening member is movably disposed in the second sliding chute opening.

10. The dust container according to claim 8, wherein the lid comprises a second sliding chute opening corresponding to the second fastening member, and the second fastening member extends out of the lid through the second sliding chute opening.

11. A dust collector, comprising:

a body, comprising a opening, the opening comprising a chamber, the body comprising a pair of buckle slots; and a dust container, detachably disposed in the chamber, the dust container comprising:

a receiving body, comprising a lid and a case; and a first fastening device, disposed in the lid, the first fastening device comprising a pair of movable first operating members and a first elastic member between the first operating members, the pair of first operating members each comprising a first fastening member;

wherein the pair of first operating members have a fixing position normally butted by the first elastic member and a releasing position for relatively compressing the first elastic member; at the releasing position, the pair of first fastening members retract into the lid, and at the fixing position, the pair of first fastening members protrude out of the lid; and when the receiving body is assembled into the chamber, the pair of first fastening members extend into the pair of buckle slots.

12. The dust collector according to claim 11, wherein the first fastening device further comprises two first elastic members, the case further comprises a butting portion, and the first elastic members are disposed between the butting portion and the pair of first operating members respectively.

13. The dust collector according to claim 11, wherein the lid is pivoted to the case.

14. The dust collector according to claim 11, wherein the lid comprises a pair of first sliding chutes, and the pair of first fastening members are movably disposed at the pair of first sliding chutes.

15. The dust collector according to claim 11, wherein the lid comprises a pair of first sliding chute openings corresponding to the pair of first fastening members, and the pair of first fastening members extend out of the lid through the pair of first sliding chute openings.

16. The dust collector according to claim 11, wherein the pair of first operating members further comprise a finger lock portion respectively.

17. The dust collector according to claim 13, wherein the lid and the case are disposed with a second fastening device correspondingly.

18. The dust collector according to claim 17, wherein the second fastening device comprises a movable second operating member and a second elastic member, the second operating member further comprises a second fastening member, and a notch corresponding to the second fastening member is disposed in the case.

19. The dust collector according to claim 18, wherein the lid comprises a second sliding chute, and the second fastening member is movably disposed in the second sliding chute opening.

20. The dust collector according to claim 18, wherein the lid comprises a second sliding chute opening corresponding to the second fastening member, and the second fastening member extends out of the lid through the second sliding chute opening.

* * * * *